United States Patent [19]

Yamaguchi et al.

[11] Patent Number: 4,669,888

[45] Date of Patent: Jun. 2, 1987

[54] APPARATUS FOR MIXING LIQUID

[75] Inventors: Shogo Yamaguchi; Enichi Yoshikawa, both of Nagoya, Japan

[73] Assignee: Mitsubishi Jukogyo Kabushiki Kaisha, Tokyo, Japan

[21] Appl. No.: 696,108

[22] Filed: Jan. 29, 1985

[30] Foreign Application Priority Data

Feb. 16, 1984 [JP] Japan ..... 59-27701

[51] Int. Cl.[4] ..... B01F 15/02

[52] U.S. Cl. ..... 366/177; 366/182

[58] Field of Search ..... 366/160, 162, 163, 177, 366/182; 222/129.1, 136

[56] References Cited

U.S. PATENT DOCUMENTS 2,835,481 5/1958 Cox ..... 366/177 X
2,894,732 7/1959 Taber et al. ..... 366/162 X
3,948,490 4/1976 Troope ..... 366/160 X
4,090,262 5/1978 Schneider et al. ..... 366/162 X

FOREIGN PATENT DOCUMENTS 2619810 11/1977 Fed. Rep. of Germany ..... 366/160

*Primary Examiner*—Philip R. Coe
*Attorney, Agent, or Firm*—Holman & Stern

[57] ABSTRACT

An apparatus for mixing two kinds of liquids in a predetermined ratio by using a constant volume pump. A first liquid and a second liquid are stored in tanks and maintained at a predetermined pressure, respectively. The first and second liquids are supplied to a mixing device near the suction side, or inlet, of a constant volume pump and the second liquid supplied to the mixing device is measured by a measuring device to adjust it to a predetermined amount so that the first and second liquids are mixed in a predetermined ratio.

8 Claims, 2 Drawing Figures

APPARATUS FOR MIXING LIQUID

BACKGROUND OF THE INVENTION

1. Field of the Invention

The present invention relates to an apparatus for having a first liquid containing gas such as carbon dioxide or nitrogen gas and mixing the first liquid and a second liquid in a predetermined ratio for use in manufacture of cooling beverages or for general industry use.

2. Description of the Prior Art

FIG. 1 shows a construction of a prior art liquid mixing apparatus for use in a manufacturing process of a cooling beverage.

Water to be processed for the manufacture of the cooling beverage is supplied through an inlet 1 to a tank 4 for use in the evacuation of oxygen while controlling a liquid level in the tank 4 so that the level is maintained to a predetermined level by a water control valve 2. The tank 4 may be of a packed tower type, a wetted-wall column type, or a tray tower type. A vacuum unit 3 is coupled to the tank 4 so that oxygen contained in the water to be processed is evacuated under vacuum in the tank 4. The evacuated water is sent out through an outlet pipe 5 a check valve 7 and a water pipe 8 to a liquid mixing apparatus by means of a water pump 6.

An inlet valve 9 serves to always maintain constant a level of the evacuated water supplied to a water tank 10.

A syrup supply valve 12 serves to maintain constant a level of syrup for use in the manufacture of a cooling beverage in a syrup tank 13 supplied from a supply port 11. Water in the tank 10 and syrup in the tank 13 are applied with an atmospheric pressure or are pressurized by the same pressure if necessary.

The evacuated water is supplied from the water tank 10 through a water measuring valve 14 and a water mixing valve 15 to a mixing tank 18. The amount of flowing into the mixing tank 18 is substantially propotional to an opening of the water measuring valve 14 since the pressure applied to the water tank 10 is maintained constant and a difference between a level of the water tank 10 and a level of the mixing tank 18 is always maintained approximately constant.

Syrup is supplied from the syrup tank 13 through a syrup measuring valve 16 and a syrup mixing valve 17 to the mixing tank 18. The amount flowing into the mixing tank 18 is substantially proportional to an opening of the syrup measuring valve 16 since the pressure applied to the syrup tank 13 is maintained constant and a difference between a level of the syrup tank 13 and a level of the mixing tank 18 is always maintained approximately constant.

The mixed liquid in the tank 18 is sent out under pressure by a mixing pump 19 through a control valve 20 to a polycarbonator 21. The control valve 20 is to automatically control the level of the mixing tank 18 to a constant level.

The mixed liquid at a constant flow rate and supplied through the control valve 20 and the carbon dioxide gas at a constant flow rate and supplied from a supply port 22 through a valve 23 are supplied to a polycarbonator 21. The mixed liquid absorbs the carbon dioxide gas within a pipe 24.

The mixed liquid flows into a carbonator tank 26 through the pipe 24 and a check valve 25 while absorbing carbon dioxide in the polycarbonator 21 if necessary. The carbonator tank 26 is connected through a pressure regulating valve 28 to a gas supply port 27 through which carbon dioxide gas is supplied to the tank 26 so that a pressure within the tank 26 is maintained constant. A cooling unit for the mixed liquid is installed on a way of the pipe 24 if desired, or a cooling plate is disposed in the tank so that the mixed liquid in the tank 26 can be cooled to a predetermined temperature.

The mixed liquid supplied in the carbonator tank 26 is a product containing a necessary amount of carbon dioxide gas absorbed under the pressurized carbon dioxide gas, and is stored below the tank 26 to be supplied through an outlet 29 to a next process under pressure.

With the above prior art liquid mixing process for manufacturing cooling beverages, since the processes including the evacuation process, the mixing process of the evacuated water and syrup in a predetermined ratio, polycarbonation and carbonation are independent, control mechanisms and pipes between the tanks and the units are necessary and large in structure. Since the carbonation is performed in the mixed liquid having poor gas absorption, a relatively large gas absorber, that is a carbonation tank, is required. Further, since there are many tanks, the portion or areas to be sterilized and washed are large, and the time and amount of liquid required for the sterilization and washing are great.

BRIEF SUMMARY OF THE INVENTION

The present invention has been made in view of the above problems and an object of the present invention is to provide a liquid mixing apparatus for effectively and readily attaining evacuation, mixing and gas absorption processes with a small and economical structure.

A further object is to provide a liquid mixing apparatus for effecting the evacuation of oxygen contained in a first liquid by a gas replacement operation in a first tank maintained to a predetermined pressure by gas and including a gas purge unit and at the same time effecting absorption of gas, passing the evacuated liquid and a second liquid in a second tank maintained at the same pressure as that in the first tank in respective predetermined flow rates through measuring means, respectively, and mixing them at a suction side of a constant volume pump to make a mixed liquid containing gas. According to the present invention, since the gas replacement operation is made using gas absorbed into the first liquid in the first tank including the gas purge unit, the evacuation of oxygen contained in the first liquid and the absorption of gas into the first liquid are attained at the same time. Further, since gas is absorbed into the first liquid, the absorption of gas can be efficiently made. The first liquid and the second liquid are sucked to the suction side of the constant volume pump in the respective predetermined flow rates to mix them and therefore the first and second liquids can be mixed in a predetermined ratio without a mixing tank.

It is also an object of the present invention to provide a liquid mixing apparatus comprising a first tank, a first liquid supply unit for supplying a predetermined amount of first liquid through a liquid level controller into the first tank, a gas purge unit provided in the first tank, a second tank, a second liquid supply unit for supplying a predetermined amount of second liquid through a liquid level controller into the second tank, a gas supply unit for supplying gas having a predetermined pressure and absorbed into the first liquid to the first and second tank, a constant volume pump connected to the first tank through measuring means for sending out a mixed liquid under pressure, and a second liquid mixing unit for sucking the second liquid from the second tank through measuring means and a nozzle to the suction side of the constant volume tank to mix the second liquid into the first liquid. According to the present invention, the above method is capable of being performed by the present apparatus, and since an independent evacuation tank, mixing tank, pipes therebetween and control units therefor are not necessary, the apparatus can be extremely simple and compact in structure and economical.

In the present invention, the first and second liquids may be any kinds of liquids without limitation to water and syrup.

BRIEF DESCRIPTION OF THE DRAWINGS

The invention will now be described in detail with reference to the accompanying drawings wherein.

DETAILED DESCRIPTION

Figure 1:
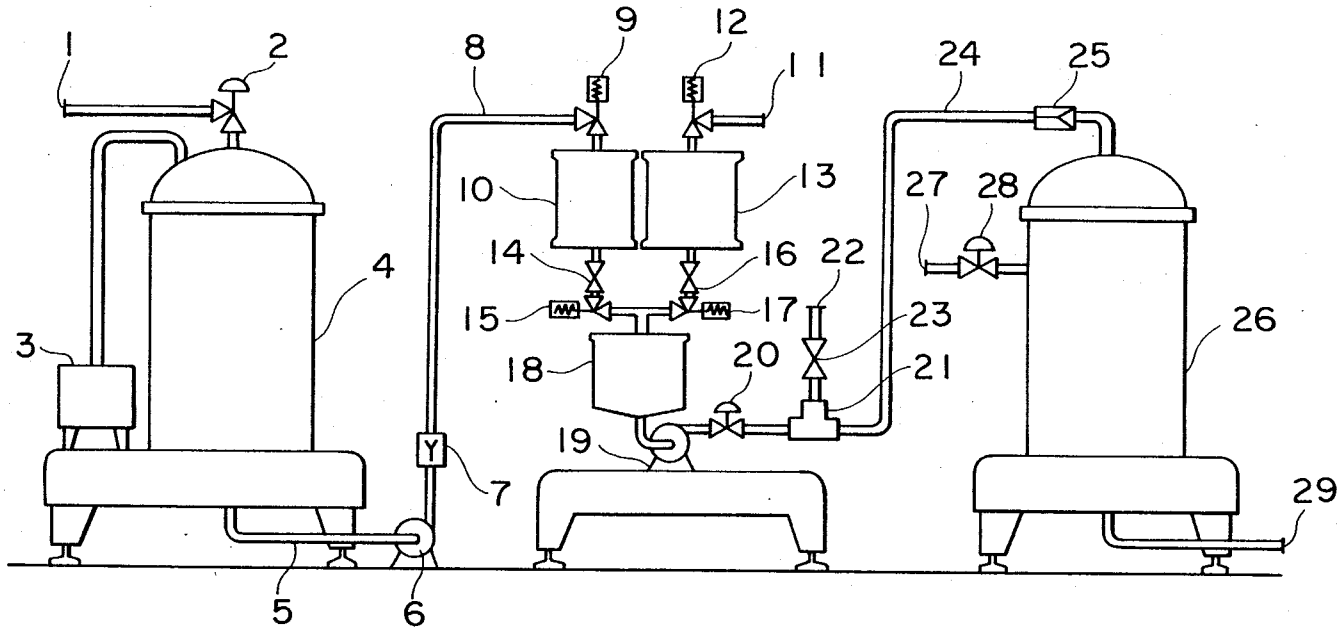
FIG. 1 PRIOR ART
FIG. 1 is a schematic diagram showing a prior art mixing apparatus.
Figure 2:
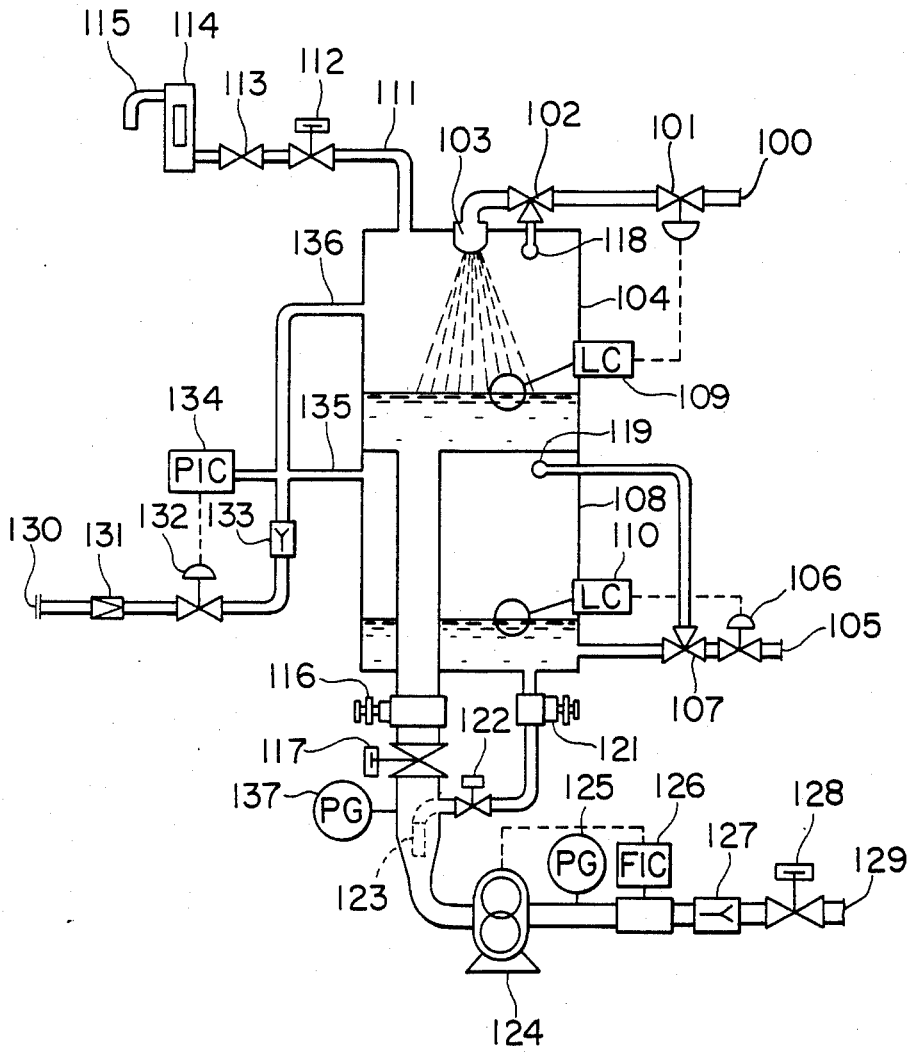
FIG. 2 is a schematic diagram showing a mixing apparatus incorporating an embodiment of the present invention.

FIG. 2 shows a liquid mixing apparatus having an embodiment according to the present invention, in which numeral 100 denotes a supply port of water to be processed which is provided with a liquid level control valve 101. A change-over valve 102 is used to switch a flow way to a supply nozzle 103 for water to be processed or to a washing spray 118. Numeral 104 denotes a water tank and numeral 109 denotes a liquid level controller. Water supplied from the port 100 is controlled by the liquid level controller 109 and the control valve 101 in response to the liquid level in tank 104 to maintain the liquid level in the tank constant. The change-over valve 102 is used to supply water to the washing spray 118 when the water tank is washed.

Numeral 111 denotes an exhaust pipe connected to the water tank 104, numeral 112 denotes an open and close valve, numeral 113 denotes a flow rate adjusting valve, numeral 114 denotes a gas flow meter and numeral 115 denotes an exhaust port. These components form means for purging the pressurized gas in the water tank 104 through the pipe 111 valves 112 and 113 and the exhaust port 115 to the outside while adjusting the exhaust flow rate by the gas flow meter 114.

Numeral 105 denotes a syrup supply port. A liquid level control valve 106 and a change-over valve 107 are disposed in the pipe from the syrup supply port 105. The change-over valve 107 switches the flow to a syrup tank 108 or to a washing spray 119. An amount of syrup supplied from the syrup supply port 105 is controlled by a liquid level controller 110 and the liquid level control valve 106 in accordance with the liquid level in the syrup tank 108 and the liquid level in the tank 108 is maintained constant. The change-over valve 107 is used to supply washing water to the washing spray 119 when the inside of the syrup tank 108 is washed.

A gas supply port 130 is connected through a pressure reducing valve 131, a pressure adjusting valve 132, a check valve 133, a pressure adjusting meter 134 and gas ports 135 and 136 to the syrup tank 108 and the water tank 104. $CO_2$ gas, $N_2$ gas or the like is supplied from the gas supply port 130 and the pressure in the water tank 104 and the syrup tank 108 is maintained at a predetermined pressure by the pressure adjusting valve 132 and the pressure adjusting meter 134.

Numeral 116 denotes a water measuring valve, 117 a water open and close valve, 121 a syrup measuring valve, 122 a syrup open and close valve, 123 a syrup mixing nozzle, 137 a pressure gauge and 124 a constant volume pump. The water open and close valve 117 and the syrup open and close valve 122 are automatic valves which open and close in synchronism with the start and stop operation of the constant volume pump 124.

The water measuring valve 116 is to adjust an amount of water flowing from the water tank 104 and the syrup measuring valve 121 is to adjust an amount of syrup flowing from the syrup tank 108. The syrup mixing nozzle 123 is to disperse syrup into water.

A pressure gauge 125 is to measure an output pressure of the constant volume pump 124. A flow meter 126 can automatically control the rpm of the pump 124, if necessary, to control an amount of flowing mixed liquid constant, or can be used to adjust the rpm of the pump 124.

Numeral 127 denotes a check valve, numeral 128 denotes an open and close valve, and numeral 129 denotes an outlet of the mixed liquid. The check valve 127 is to prevent the mixed liquid from flowing reversely or leaking out when the pump 124 is stopped.

Water supplied from the supply port 100 is supplied to the tank 104 and is subject to the evacuation process and the absorption process of gas in the water tank 104 maintained to a predetermined pressure by $CO_2$ gas, $N_2$ gas or the like supplied from the gas supply port 130.

When the pressure in the water tank 104 is maintained at a predetermined pressure by $CO_2$ gas, water supplied from the port 100 absorbs $CO_2$ gas under an atmosphere of pressurized $CO_2$ gas and at the same time air (mainly $O_2$ and $N_2$) absorbed in the water is separated. When the pressure in the water tank 104 is maintained at a predetermined pressure by $N_2$ gas, water supplied from the port 100 absorbs $N_2$ gas under an atmosphere of pressurized $N_2$ gas at the same time oxygen $O_2$ in air (mainly $O_2$ and $N_2$) absorbed in the water is separated.

Gas such as $CO_2$ gas or $N_2$ gas is supplied to the water tank 104 from the gas inlet 136 and $N_2$ or $O_2$ in air separated from the water is exhausted from the exhaust port 115 through the exhaust pipe 111, the valves 112, 113 and gas flow meter 114 at an economical exhaust gas flow rate. Thus, the gas purity of $CO_2$ gas or $N_2$ gas in the water tank 104 is maintained at a predetermined value or more. The open and close valve 112 is a valve which opens when water is processed and functions to effectively purge $CO_2$ gas or $N_2$ gas.

In this manner, water in the tank 104 is subject to the absorption treatment of $CO_2$ or $N_2$ gas and at the same time is subject to the separation treatment of $N_2$ or $O_2$ gas contained in air dissolved in the water to be processed. The pressure adjusting meter 134 and the flow rate adjusting valve 113 adjust the degree of the treatment.

The pressure in the water tank 104 and the syrup tank 108 is maintained at the identical predetermined pressure, and the liquid levels in the water tank 104 and the syrup tank 108 are maintained at respective predetermined levels. The evacuated water in the water tank 104 is sucked by the constant volume pump 124 through the measuring valve 116 and the valve 117. Syrup in the tank 108 flows out from the mixing nozzle 123 into the flow of water through the measuring valve 121 and the valve 122.

The flow rate of water is determined by the pressure difference between the applied pressure of the water tank 104 and the pressure measured by the pressure gauge 137 and the opening of the water measuring valve 116. The flow rate of syrup is determined by the pressure difference between the applied pressure of the syrup tank 108 and the pressure measured by the pressure gauge 137 and the opening of the syrup measuring valve 121.

The pressure near the mixing nozzle 123 can be measured by the pressure gauge 137 and when the rpm of the constant volume pump 124 is changed, the pressure near the nozzle 123 can be changed.

The constant volume pump 124 maintained constant the pressure difference between the internal pressure of the syrup tank 108, which is the identical pressure with that of the water tank 104, and the circumferential pressure of the syrup mixing nozzle 123 to send out the mixed liquid of water and syrup at a predetermined flow rate. Since the flow rate of the mixed liquid depends on the constant volume characteristic of the constant volume pump 124 and can be set by the rpm of the pump, the flow meter and the flow rate adjusting valve can be eliminated.

Since the constant volume characteristic of the pump 124 is affected by a back pressure of the pump, when the back pressure changes, there are two methods for increasing accuracy of the flow rate of the mixed liquid as will now be described.

In a first method, the rpm of the pump 124 is adjusted by the flow rate measured by the flow meter 126 for a pressure measured by the pressure gauge 125 to make constant the flow rate of the mixed liquid. This method can be also effected by automatic control.

In a second method, the flow rate of the mixed liquid is adjusted constant by utilizing the fact that the flow rate of the mixed liquid is proportional to the rpm of the pump 124 when the opening of the control valve 128 is adjusted to maintain constant the circumferential pressure of the syrup mixing nozzle 123 measured by the pressure gauge 137 and maintain constant the output pressure of the pump 124.

When the rpm of the constant volume pump 124 is adjusted while maintaining the internal pressure of the water tank 104 and the internal pressure of the syrup tank 108 to a predetermined pressure and the flow rate of the mixed liquid maintains constant, the circumferential pressure of the syrup mixing nozzle 123 can be determined and the ratio of the flow rates of water and syrup can be set by adjusting the opening of the water measuring valve 116 and the syrup measuring valve 121. In this manner, water, which is subject to the absorption of $CO_2$ or $N_2$ gas in the water tank 104 and the separation of $N_2$ or $O_2$ gas in air absorbed in the water, and syrup can be mixed in a predetermined ratio.

Accordingly, the following numerous effects can be obtained:

(1) As compared with the prior art, an evacuation tank and a mixing tank are not required and the number of tanks is two;

(2) Since the evacuation tank is not necessary (using the water tank in the prior art), its associated water supply control equipment, pump for sending out the evacuated water under pressure and pipes for supplying liquid are all unnecessary and the number of components is greatly reduced;

(3) Since the evacuation process is a replacement process using $CO_2$ gas or $N_2$ gas, the vacuum unit is not required and the pressure adjusting mechanism in place of the vacuum unit is simple;

(4) Since the evacuation of water is made at the same time as the absorption of $CO_2$ gas or $N_2$ gas and the gas absorption into water is large as compared with the absorption of $CO_2$ or $N_2$ gas into the mixed liquid, gas is absorbed effectively;

(5) Water containing $CO_2$ gas and syrup are mixed to manufacture the mixed liquid containing $CO_2$ gas, and a polycarbonator required in the prior art can be eliminated;

(6) Water containing $CO_2$ gas and syrup are mixed to manufacture the mixed liquid containing $CO_2$ gas, and a polycarbonator required in the prior art can be made small or simple in structure;

(7) By controlling the rpm of the constant volume tank to maintain the setting flow rate of the mixed liquid, water and syrup can be mixed in a predetermined ratio without influence of the pressure in the output of the constant volume pump, that is the back pressure;

(8) By providing the flow rate adjusting valve in the output side of the constant volume pump to maintain constant the output pressure of the constant volume pump, water and syrup can be mixed in a predetermined ratio without influence of the back pressure to the flow rate of the mixed liquid.

We claim:

1. A liquid mixing apparatus comprising:

a first tank;

a first liquid supply unit comprising a liquid level control means for supplying a predetermined amount of first liquid to said first tank;

means for purging gas from said first tank;

an outlet conduit from said first tank for said first liquid;

a constant volume pump having an inlet connected to said first tank outlet conduit;

a measuring means in said first tank outlet conduit for measuring the flow of said first liquid through said first tank outlet conduit;

a second tank;

a second liquid supply unit comprising a liquid level control means for supplying a predetermined amount of second liquid to said second tank;

a gas supply means for supplying gas at a predetermined pressure to said first and second tanks;

an outlet conduit connected at one end to said second tank for said second liquid and operatively connected with said constant volume pump inlet;

a measuring means in said second tank outlet conduit; and a second liquid mixing unit in said second tank outlet conduit comprising a nozzle for sucking said second liquid from said second tank and mixing said first and second liquids.

2. A liquid mixing apparatus as claimed in claim 1 wherein:

said nozzle is disposed in said first tank outlet conduit and has a nozzle inlet connected to the other end of said second tank outlet conduit.

3. A liquid mixing apparatus as claimed in claim 2 wherein said liquid level control means for said first and second liquids each comprises:

a liquid inlet pipe;

a liquid level control valve in said liquid inlet pipe; and a liquid level controller for detecting the liquid level in the respective tank and operatively connected to said control valve for operating said control valve.

4. A liquid mixing apparatus as claimed in claim 3 wherein said purging means comprises:

a purging contuit connected at one end to said first tank above the liquid level therein and being open to the atmosphere at the other end;

an on-off valve in said purging conduit;

a flow rate adjusting valve in said purging conduit; and a gas flow meter in said purging conduit.

5. A liquid mixing apparatus as claimed in claim 4 wherein said gas supply means comprises:

an interconnected gas supply conduit means connected in parallel to said first and second tanks respectively above the liquid level in each tank and having an outer end open to the atmosphere;

a pressure reducing valve in said gas supply conduit;

a pressure adjusting valve in said gas supply conduit;

a pressure adjusting meter connected to said gas supply conduit for detecting the pressure therein and operatively connected to said pressure adjusting valve to control said pressure adjusting valve in response to the pressure detected; and a check valve in said gas supply conduit between said pressure adjusting valve and said tanks.

6. A liquid mixing apparatus as claimed in claim 1 wherein said liquid level control means for said first and second liquids each comprises:

a liquid inlet pipe;

a liquid level control valve in said liquid inlet pipe; and a liquid level controller for detecting the liquid level in the respective tank and operatively connected to said control valve for operating said control valve.

7. A liquid mixing apparatus as claimed in claim 1 wherein said purging means comprises:

a purging conduit connected at one end to said first tank above the liquid level therein and open to the atmosphere at the other end;

an on-off valve in said purging conduit;

a flow rate adjusting valve in said purging conduit; and a gas flow meter in said purging conduit.

8. A liquid mixing apparatus as claimed in claim 1 wherein said gas supply means comprises:

an interconnected gas supply conduit means connected in parallel to said first and second tanks respectively above the liquid level in each tank and having an outer end open to the atmosphere;

a pressure reducing valve in said gas supply conduit;

a pressure adjusting valve in said gas supply conduit;

a pressure adjusting meter connected to said gas supply conduit for detecting the pressure therein and operatively connected to said pressure adjusting valve to control said pressure adjusting valve in response to the pressure detected; and a check valve in said gas supply conduit between said pressure adjusting valve and said tanks.

* * * * *